United States Patent [19]

Bookout et al.

[11] Patent Number: 4,536,137

[45] Date of Patent: Aug. 20, 1985

[54] SUBMERGIBLE PUMPING APPARATUS

[75] Inventors: Russell J. Bookout, Bartlesville, Okla.; Bernard A. Pearson, Bothell; John W. Jacobs, Seattle, both of Wash.

[73] Assignee: TRW Inc., Cleveland, Ohio

[21] Appl. No.: 429,177

[22] Filed: Sep. 30, 1982

[51] Int. Cl.[3] ..... F04B 47/08

[52] U.S. Cl. ..... 417/390; 91/313; 92/165 R; 417/397; 417/563; 417/571

[58] Field of Search ..... 417/397, 403, 404, 390, 417/571, 567, 393, 563; 91/312, 313; 277/2, 59, 133; 92/165

[56] References Cited

U.S. PATENT DOCUMENTS

| | | | |
|---|---|---|---|
| 1,714,425 | 5/1929 | Knab | 417/397 |
| 2,152,802 | 4/1939 | Harris | 417/390 |
| 2,394,364 | 2/1946 | Christensen | 277/59 |
| 2,427,616 | 9/1947 | Mohler | 417/397 X |
| 2,799,225 | 7/1957 | Schoen | 417/567 X |
| 2,812,721 | 11/1957 | Coberly | 417/567 X |
| 3,091,181 | 5/1963 | Wolf | 417/403 X |
| 3,370,545 | 2/1968 | Waibel | 417/571 |
| 3,652,187 | 3/1972 | Loeffler et al. | 417/393 |
| 4,234,295 | 11/1980 | Jensen | 417/390 |
| 4,406,598 | 9/1983 | Walling | 417/404 |

*Primary Examiner*—Leonard E. Smith

*Attorney, Agent, or Firm*—Shapiro and Shapiro

[57] ABSTRACT

Submergible pumping apparatus for use in an oil or other well comprises, in a self-contained downhole unit, a double-acting reciprocating positive displacement pump for pumping well fluid, a reservoir containing power fluid for operating the double-acting pump, a rotary motor-driven positive displacement pump for supplying power fluid under pressure from the reservoir to operate the reciprocating pump, and a control valve for properly directing high pressure power fluid from the rotary pump to the reciprocating pump and from the reciprocating pump back to the reservoir so as to provide stroke reversal of the reciprocating pump.

2 Claims, 19 Drawing Figures

6
6A
6B
16
18
62
110
113
122
180
182
195
206
216
218
220
222
224
226
228
230
232
234
236
238
240
242
244
246
248
250
254
256
258
260
262
330

SUBMERGIBLE PUMPING APPARATUS

FIELD OF THE INVENTION

This invention relates generally to submergible pumping apparatus for use in oil and like wells. More particularly, the invention is concerned with submergible pumping apparatus that includes a positive displacement pump and which is suited for use in deep wells yielding small volumes of fluid. For example, the equipment may be used effectively in wells with casing diameters of about 4½ inches and in wells producing under 250 barrels per day.

BACKGROUND OF THE INVENTION

Four artificial lift systems commonly used in deep wells of low output are: beam pump systems; gas lift; submergible centrifugal pump systems; and hydraulic pump systems.

Major components of a beam, or sucker rod, pump system are a surface mounted reciprocating beam unit, a sucker rod string, and a downhole pump. The surface unit is the largest expense item in the system, and the expense increases as the pumping depth and flow rate increases. A considerable amount of preventive maintenance is required in order to maintain the system operational, since the moving parts need lubrication, and the system includes a stuffing box requiring periodic tightening to ensure good sealing of the sucker rod at the surface. Also, with this system, as the rod string increases in length, it tends to stretch and contract during a greater portion of the stroke, thus reducing the efficiency of the system.

Gas lift is a relatively simple and reliable method for obtaining lift in a well. It is accomplished by injecting gas into the well at predetermined depth(s), either continuously, to lower the pressure of the formation so that the fluid will flow freely, or intermittently, at a high instantaneous rate for a short time, to surface columns of fluid at regular intervals. There is, however, a sharp increase in power required per barrel of fluid produced at rates below 250 barrels per day, although this is influenced, to an extent, by tubing size. The gas lift technique also requires a source of gas which may not be present at a well in the required quantities.

Submergible centrifugal pumping systems generally consist of an electric motor, a motor protector, a centrifugal pump (usually having multiple stages) and frequently a gas separator at the pump intake. Traditionally, these systems have been best applied in wells of high output (in excess of 250 BPD) at depths up to 15,000 feet. Centrifugal pumps tend to become inefficient at low flow rates, and difficult to produce when the openings in the stages become narrow slits designed to pump at low flow rates.

Hydraulic oil well pumping systems generally consist of a surface pump and filtration system which supplies high pressure clean fluid to a downhole hydraulically driven reciprocating pump. With these systems, high pressure power fluid at the surface can present a fire hazard in case of a leak. Further, in many cases, the system requires an extra tubing string for the flow of well fluid to the surface, and this can be a major cost item. Due to the separation of the donwhole pump from the surface fluid supply, the amount of energy stored in compression of the fluid and expansion of the supply line can be considerable. If the downhole pump control valve is not designed to handle this fluid in a no-load condition, the pump may reciprocate too rapidly, resulting in premature failure. This necessitates a complex screening valve.

The present invention provides alternative downhole pumping apparatus that is more satisfactory than traditional systems, particularly in deep wells (for example, deeper than 5,000 feet) that have low output, i.e., lower than 250 barrels per day.

SUMMARY OF THE INVENTION

In accordance with one aspect of the invention, a self-contained downhole pumping unit includes a reciprocating positive displacement piston-operated pump, a reservoir for power fluid to operate the pump, a motor-driven pump for supplying high pressure power fluid from the reservoir to the piston-type pump, and a control valve for directing the power fluid alternately to opposite sides of the power cylinder of the piston-type pump and returning power fluid to the reservoir.

Preferably, the piston-type pump includes a pair of pump plungers connected to the power piston on opposite sides thereof, and which alternately take in and discharge well fluid as the piston reciprocates to provide a double-acting effect. The plungers may operate in opposed pump chambers, each having inlet and outlet valves for fluid being pumped. Conveniently, the outlets of the respective chambers connect into a common pump discharge fitting.

The motor-driven pump for supplying power fluid to the power piston may, for example, comprise a known form of rotary positive displacement pump, such as a gerotor pump, and this may be driven, for example, by a conventional submergible motor.

The control valve may conveniently take the form of a spool valve having a valve rod formed as a section of the main piston-plunger assembly, and a tubular spool surrounding the rod and contained in a valve housing. The spool and housing may have suitable passages and the like for providing circulation of power fluid from the motor-driven pump alternately to opposite sides of the power piston dependent on the position of the valve rod and spool, whereby movement of the piston itself is effective to change the position of the valve (by movement of the valve rod) to effect stroke reversal.

Additional features of the invention will become apparent from the following description and claims taken in conjunction with the accompanying drawings.

BRIEF DESCRIPTION OF DRAWINGS

FIGS. 4 to 10 are longitudinal cross-sectional views of parts of a practical embodiment of the pumping apparatus shown in FIGS. 1A and 1B, and which are intended to be placed end to end in the manner shown in FIG. 3 to illustrate the complete apparatus. In FIGS. 4 to 10, the apparatus is shown on its side; and for ease of understanding, these sectional views illustrate the apparatus as seen at different cutting planes, as indicated in FIGS. 5A–8A. FIGS. 5A, 6A, 6B, 7A and 8A are cross-sectional views on the corresponding lines of FIGS. 5, 6, 7, and 8 showing the cutting planes on which FIGS. 5, 6, 7, and 8 are drawn.

DESCRIPTION OF PREFERRED EMBODIMENTS

Figure 1A:
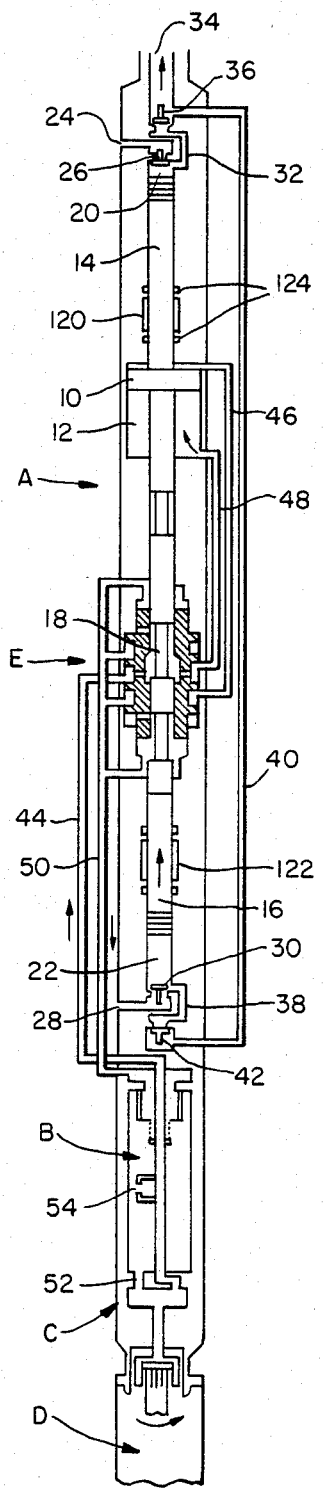
FIG. 1A is a diagrammatic elevational view of submergible pumping apparatus in accordance with the invention with components of the apparatus shown in positions occupied when a piston-plunger assembly thereof is substantially at the top of an upstroke.

The general principles of the invention will be described initially with reference to FIGS. 1A and 1B. These figures depict, diagrammatically, submergible pumping apparatus in which a double-acting positive displacement piston-type pump A is operated by power fluid circulated through the pump from a reservoir B by means of a rotary positive displacement pump C (in the form of a gerotor pump), driven by a conventional submergible electric motor D. A control valve E produces stroke reversal of the main power piston 10 of pump A.

Power piston 10 operates in a power cylinder 12 and forms part of a piston-plunger assembly that also includes an upper plunger 14, a lower plunger 16, and a valve rod section 18, forming part of the control valve E, as will be described. Upper plunger 14 operates in an upper plunger chamber (production cylinder) 20, and lower plunger 16 operates in a lower plunger chamber (production cylinder) 22. Upper chamber 20 communicates with the exterior of the pumping apparatus via an upper fluid inlet passage 24 having an upper inlet check valve 26. Lower chamber 22 likewise communicates with the exterior through a lower fluid inlet passage 28 having a lower inlet check valve 30. The upper chamber has a fluid discharge passage 32 leading to a pump discharge fitting 34 through an upper discharge check valve 36. The lower plunger chamber similarly has a discharge passage 38 leading into a discharge riser 40 through a lower discharge check valve 42. Check valves 26, 36 and 30, 42 constitute check valve assemblies at the remote ends of the production cylinders 20 and 22. The discharge riser connects at its upper end with the pump discharge fitting.

Rotary pump C delivers working fluid from reservoir B to the control valve via duct 44; and from the control valve, the high pressure working fluid is diverted to one or other side of power piston 10 (dependent on the position of the valve) through one of ducts 46, 48. (The other of these ducts returns low pressure working fluid to the valve). Low pressure fluid from the control valve is returned to the reservoir through duct 50 and thence to the inlet of pump C through inlet passage 52. The reservoir includes an accumulator 54 to accommodate pressure fluctuations. Motor-driven pump C, reservoir B, and the associated components constitute drive means for pump A.

In FIG. 1A, the control valve is supplying high pressure power fluid from pump C to the lower end of cylinder 12, through duct 48, while low pressure power fluid from above the piston is returned to the reservoir through duct 46, valve E, and duct 50, so that the piston-plunger assembly is moving upwardly. In this condition of the apparatus, with plungers 14 and 16 moving upwardly in their respective chambers, well fluid (production fluid) is being drawn into lower chamber 22 through inlet 28 and valve 30, due to suction conditions in chamber 22, while conversely, well fluid from upper chamber 20 is being forced out into discharge fitting 34 through passage 32 and valve 36.

When piston 10 approaches the top of its stroke, valve rod section 18 attains a position in which it initiates a control valve shift producing reversal of the power fluid flow (as will be described in more detail hereafter) so that high pressure fluid from pump C is now supplied to the top of piston 10 through duct 46, while low pressure power fluid is returned from below piston 10 to the reservoir via duct 48, valve E, and duct 50. Accordingly, the piston-plunger assembly moves downwardly as indicated in FIG. 1B. In these conditions, well fluid is drawn into upper chamber 20 through inlet 24 and valve 26, while the well fluid in lower chamber 22 is discharged through passage 38 and valve 42 into riser 40.

As piston 10 reaches the bottom of its stroke, valve rod section 18 again initiates a reversal in the flow of the power fluid to provide the next upstroke of the piston-plunger assembly, so that the pumping cycle is repeated. Thus, with the apparatus fully charged, it will be apparent that well fluid is pumped through discharge fitting 34 continually on both upstrokes and downstrokes of the piston-plunger assembly.

The construction and operation of control valve E will now be described with reference to FIGS. 2A through 2D and FIG. 7, which show the valve on its side. In the illustrated configuration, the reservoir end of the pumping apparatus (the lower end) is considered to be to the right, and the power piston end of the apparatus (the upper end) is to the left. The cutting plane of FIG. 7 is at right angles to the cutting plane of FIGS. 2A to 2D.

Valve E comprises the aforementioned valve rod section 18, forming part of the reciprocating piston-plunger assembly, an axially reciprocating valve spool 56 in which rod section 18 slides, a housing or casing 58, fitting within the main housing member 62 of the pumping assembly (see FIG. 7), and in which the valve spool slides, and end seals 60 between the spool and housing.

Figure 1B:
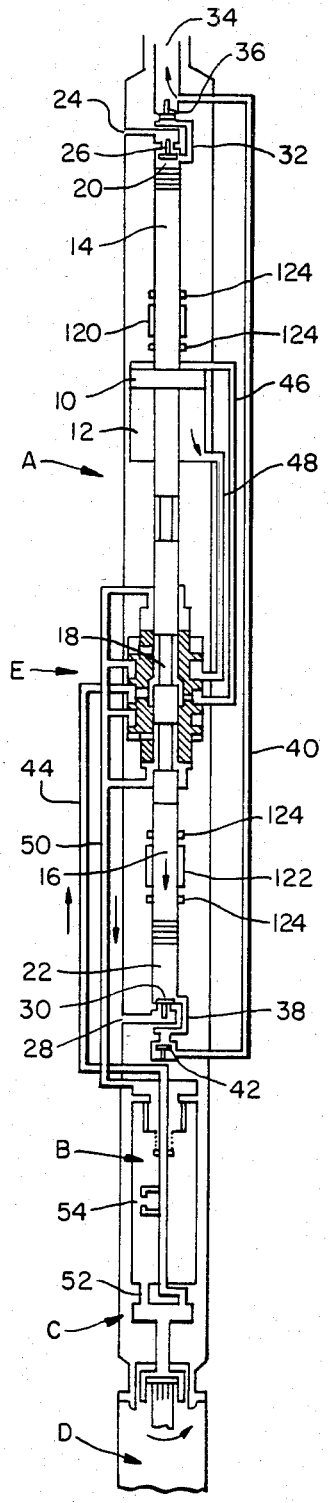
FIG. 1B is a view similar to FIG. 1A with the components shown in positions occupied when the piston-plunger assembly is at the commencement of a downstroke.

High pressure power fluid from pump C is continuously supplied to valve E via a passage 64 in the valve housing (see FIG. 7) and which corresponds to the terminal portion of duct 44 in the diagrammatic representation shown in FIGS. 1A and 1B. Passage 64 communicates via a port 66 with a central annular groove 68 formed on the interior of the valve housing.

Figures 5, 6, 6A, 6B, 7:
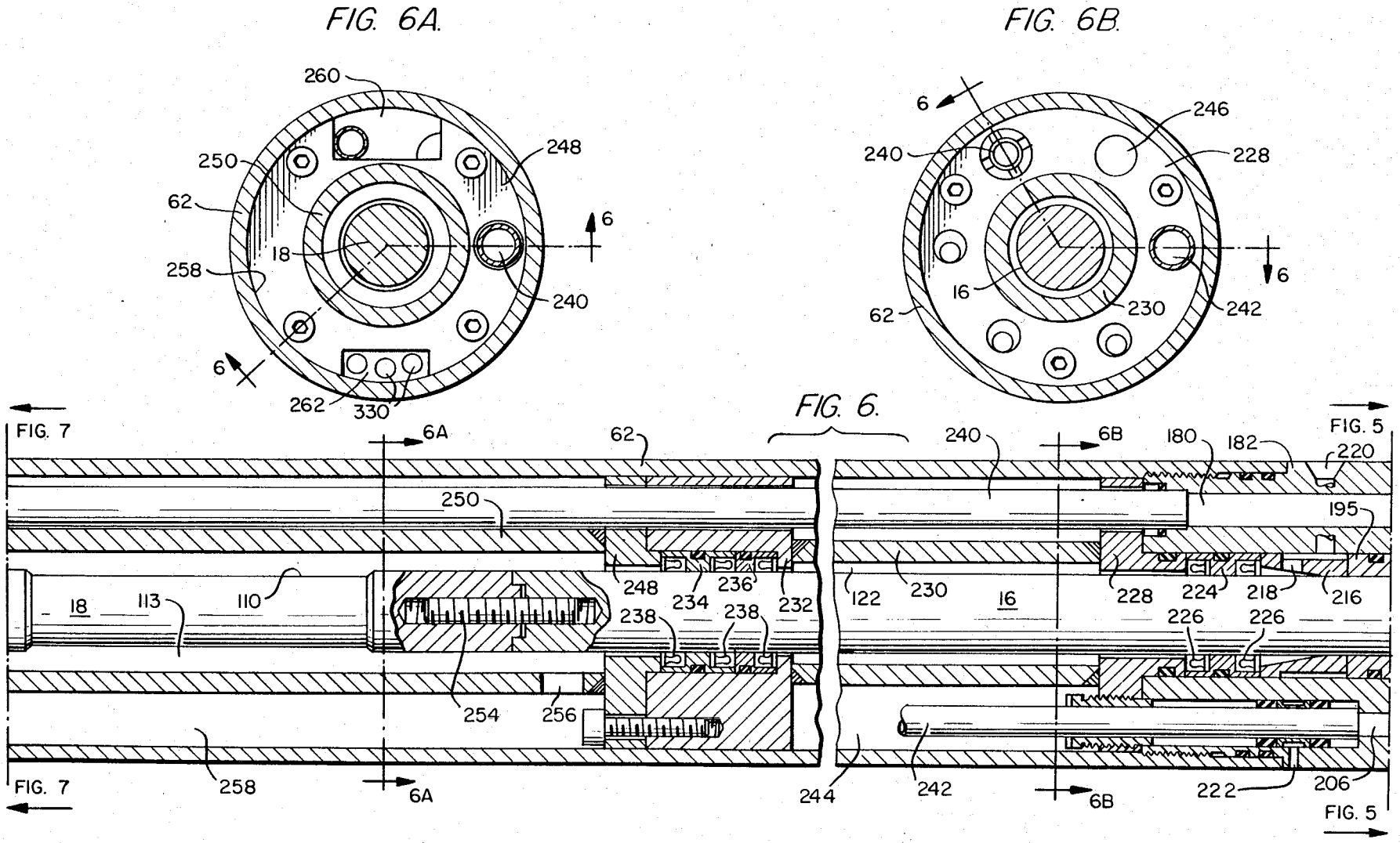

A left hand (upper) annular groove 70 on the interior of the valve housing communicates with a port 72 and passage 74 in the valve housing (FIG. 7). Passage 74 leads to the bottom end of cylinder 12 (FIGS. 1A and 1B) and corresponds to a part of duct 48. A right hand (lower) annular groove 76 on the interior of the valve housing communicates with a port 78 and passage 80 in the housing (FIG. 7). Passage 80 leads to the end of cylinder 12 and corresponds to a part of duct 46 shown in FIGS. 1A and 1B.

Valve housing 58 further includes a passage 82 (FIGS. 2A to 2D) for the return of low pressure power fluid to the reservoir, and ports, 84, 86 connecting passage 82 to the interior of the valve housing. Passage 82 corresponds to a part of duct 50 in FIGS. 1A and 1B. Additional constructional features of the control valve will become apparent from the ensuing description of its operation.

Figure 2A:
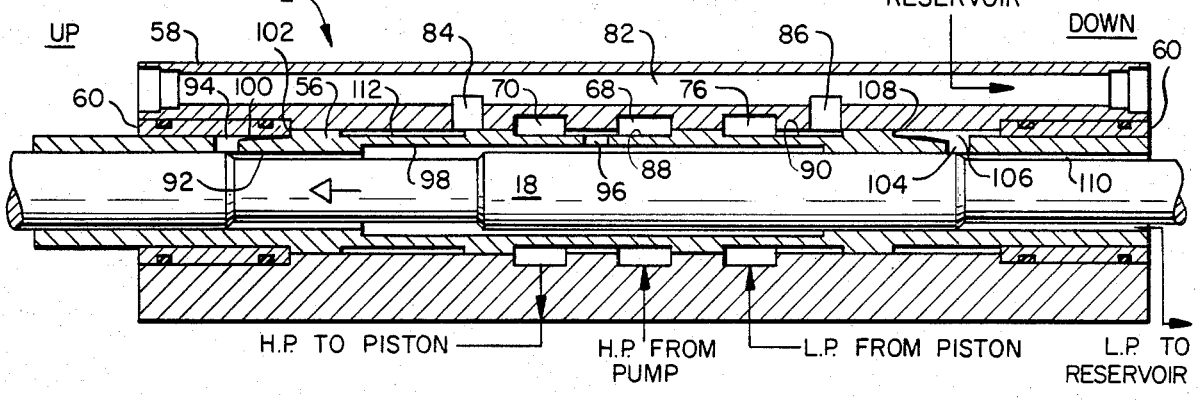
FIGS. 2A–2D are longitudinal cross-sectional views of a control valve for the apparatus and showing different valve component positions during a pumping cycle.

FIG. 2A shows valve spool 56 in the extreme left (upper) position, allowing high pressure power fluid from central groove 68 to communicate, via an external groove 88 in the valve spool, with upper groove 70, and hence the bottom end of cylinder 12, moving the piston 10 and thus valve rod section 18 to the left (upwardly). Low pressure power fluid from the upper end of cylinder 12, which is open to groove 76, through passage 80 and port 78 (FIG. 7) vents to the reservoir via a second external groove 90 in spool 56, port 86 and passage 82. Valve rod 18 in FIG. 2A has just reached a position where an actuation groove 92 in the rod opens a left (upper) vent hole 94 in the spool. This allows high pressure power fluid from groove 68 to flow via groove 88, a central vent hole 96 in the spool, a central internal spool groove 98 and a groove 92 to a left-hand actuating annulus 100 defined between an exterior shoulder 102 of the spool and left-hand seal 60. (It will be noted that the exterior of the valve spool has a chamfered portion leading from hole 94 to provide a lead in for high pressure fluid).

At the right-hand (lower) end, spool 56 has a right (lower) vent hole 104 which connects a right (lower) spool annulus 106 defined between an external spool shoulder 108 and right-hand seal 60, with a right (lower) venting groove 100 on the valve rod. In the position shown in FIG. 2A, groove 110 communicates with a right (lower) annular chamber 113 (shown in FIG. 7 but not shown in FIG. 2). Chamber 113 communicates with the reservoir as will also be described later.

Figure 2B:
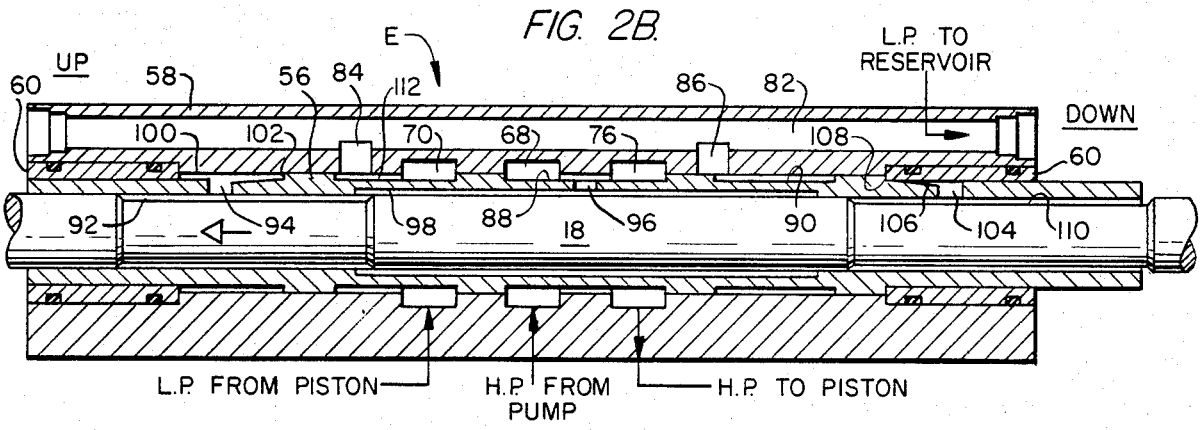

In view of the above construction, when high pressure power fluid is admitted to the left-hand annulus 100, while right-hand annulus 106 is vented to the reservoir, valve spool 56 will move to the right (downwardly) toward the extreme right-hand position shown in FIG. 2B. As the spool approaches the extreme right-hand position, flow is increasingly restricted by the decreasing flow area through the chamfered portion of right-hand annulus 106, thus decreasing the impact at the end of the valve spool stroke with the chamfer providing a cushioning effect.

When the valve spool attains the FIG. 2B position, central groove 68 (the high pressure power fluid inlet from pump C) is connected, through groove 88, to groove 76, which itself communicates with the upper end of cylinder 12. Simultaneously, groove 70 (the connection from the lower end of cylinder 12) is connected with port 84 and passage 82 leading to the reservoir, via a further groove 112 on the exterior of the valve spool. Thus, stroke reversal of the main piston 10 is effected, and the piston-plunger assembly, including valve rod section 18 moves to the right (downwardly) toward the position shown in FIG. 2C.

Figure 2C:
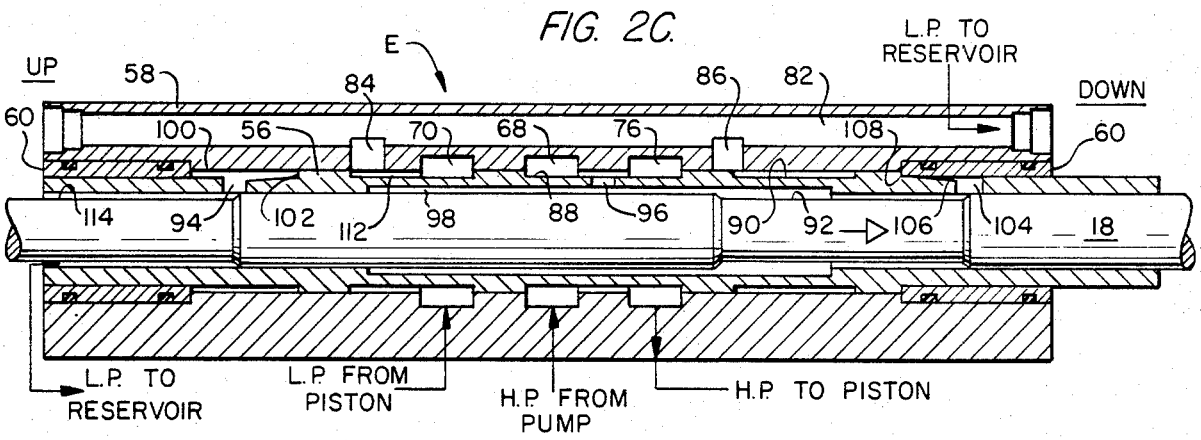

When the valve rod section 18 has moved to the FIG. 2C position, groove 92 in the rod uncovers vent opening 104 in spool 56, thereby admitting high pressure power fluid from groove 68 to the right (lower) annulus 106, via groove 88, vent opening 96, groove 98, and groove 92. Simultaneously, a further groove 114 at the left (upper) end of valve rod section 18 uncovers left vent opening 94 and connects the left-hand annulus 100 to a left-hand (upper) annular chamber 116 (FIG. 7) which communicates with the reservoir as will be described. Thus, the valve spool 56 moves to the left, toward the extreme left-hand (upper) position shown in FIG. 2D. Impact of the valve spool is again cushioned by the chamfered section of left-hand annulus 100.

Figure 2D:
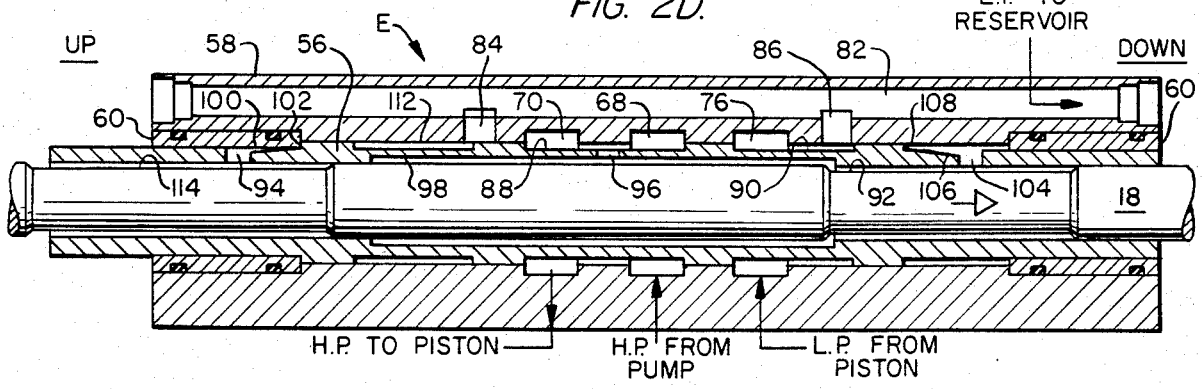

In the extreme left (upper) position of the valve spool shown in FIG. 2D, high pressure power fluid from pump C is again directed via grooves 68 and 70 to the lower end of cylinder 12, while the upper end of cylinder 12 is connected to the reservoir via grooves 76 and 90, port 86 and passage 82. Thus, the stroke of the piston-plunger assembly is again reversed, and valve rod section 18 moves to the left and returns to the FIG. 2A position. The entire cycle of valve operation and stroke reversal of the piston-plunger assembly may then be repeated.

Reverting to FIGS. 1A and 1B, it will be noted that the apparatus further includes upper and lower barrier chambes 120, 122 which embrace portions of the piston-plunger assembly between the respective plunger chamber 20 and 22 and the power fluid operational part of the apparatus (valve E and piston 10). The barrier chambers are, in use, each filled with clean fluid, which conveniently may be the same fluid as the power fluid, and their purpose is to provide a relatively clean barrier between parts of the apparatus in which relatively unclean well fluid circulates (chambers 20 and 22) and parts of the apparatus (valve E and piston 10) filled with clean power fluid, so as to avoid contamination of the power fluid with well fluid.

Plunger seals 124 are provided at the opposite ends of the respective barrier chambers, and the length of the barrier chambers relative to the length of stroke of the piston-plunger assembly is such that each of the seals wipes a different length of plunger. This enhances the barrier effect of the chamber arrangement and ensures that no surface defects will affect both sets of seals.

Figure 3:
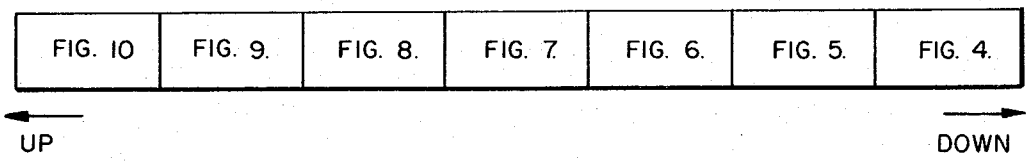
FIG. 3 is a block diagram illustrating the layout of the succeeding figures.
Figure 4:
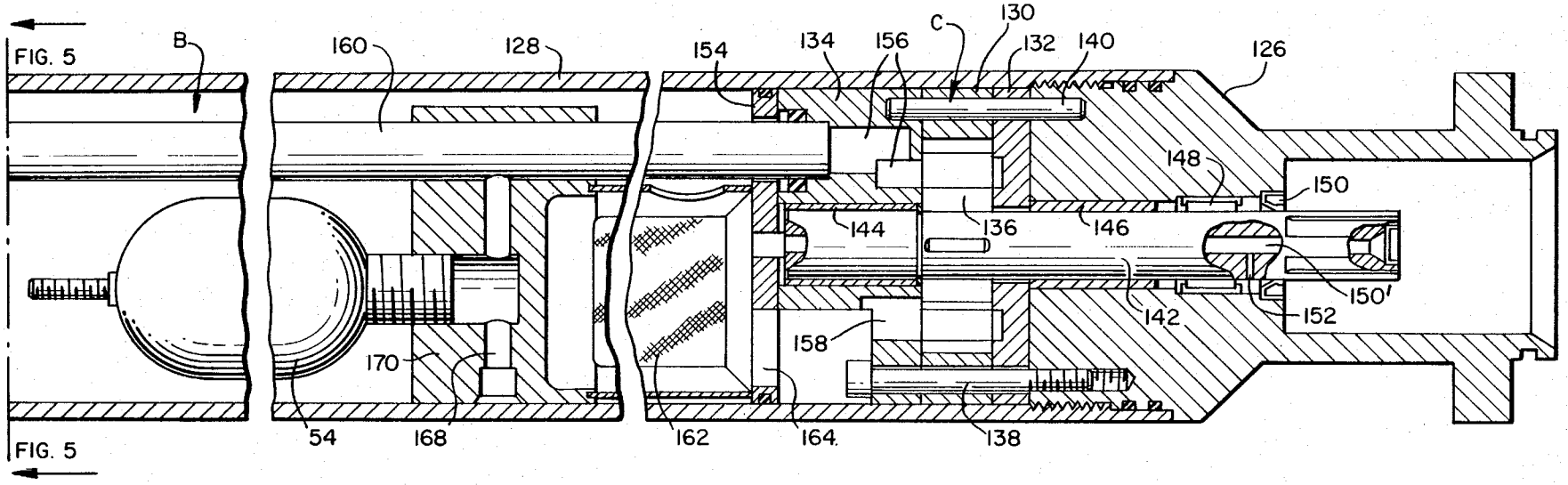

A practical form of pumping apparatus described above in principle will now be described in more detail with reference to FIGS. 3–10. It will be understood that FIG. 3 is a block diagram showing the layout of the succeeding figures, each of which shows a part of the pumping apparatus as indicated in FIG. 3. Further, FIGS. 4–10 may be positioned end-to-end in order to construct a composite view of the apparatus in its entirety. In FIG. 3 and FIGS. 4–10, the pumping apparatus is shown on its side, with its lower, inlet end (FIG. 4) to the right, and its upper, outlet end (FIG. 10) to the left. Also, the cutting planes of FIGS. 4–10 differ along the length of the pumping apparatus as indicated in FIGS. 5A to 8A, in order to obtain a better view of certain internal components of the apparatus. Description of the apparatus will commence at the lower, inlet end, FIG. 4. Like reference numerals to those used in the preceding figures are used, where practical, to denote like parts.

The inlet end of the pumping apparatus (see FIG. 4) includes a flanged inlet fitting 126 by which the apparatus may be connected to drive motor D (FIGS. 1A and 1B). To the outside of fitting 126 is secured a cylindrical housing member 128, forming a lower section of the main assembly housing. Parts 126 and 128 may, for example, have a screw connection with interposed O-ring seals, as shown. Within housing member 128 is situated the gerotor pump C for supplying high pressure working fluid to valve E and piston 10 as previously described. Pump C is a common form of positive displacement rotary gerotor pump, that is well known in the art, and will not therefore be described in detail. It includes an eccentric ring 130, end plate 132, manifold 134, and rotor 136. The end plate and eccentric ring may be secured to fitting 126 and suitably aligned by screws 138 and alignment pin 140. Rotor 136 may be keyed to a drive shaft 142 which is carried in fitting 126 and manifold 134 by sleeve bearings 144, 146. In use, shaft 142 will be coupled to the output shaft of motor D. A roller clutch 148 is interposed between fitting 126 and shaft 142 whereby the shaft can only be rotated in one direction suitable for proper operation of the gerotor pump. A shaft seal 150 is provided adjacent the roller clutch.

Motor D may be a constant speed or variable speed motor of any suitable submergible type known in the art. A change in speed of the drive motor changes the speed of reciprocation of the piston-plunger assembly, motor speed being almost directly proportional to the displacement of the reciprocating pumping apparatus.

To enhance the load-bearing qualities of bearings 144 and 146, these may be a hybrid hydrodynamic-hydrostatic design, wherein high-pressure fluid from the gerotor pump is allowed to penetrate between the shaft and bearings and operate in suitably shaped channels (not shown) which may be formed in the bearings at the shaft interface. Fluid from bearing 146 may also pass through the roller clutch and may then be returned to reservoir B by suitable passages 150', 152 formed in shaft 142 as shown.

Reservoir B occupies the volume of member 128 to the left of pump C, being separated from the pump by a seal plate 154. Manifold 134 includes a pump discharge 156 and a pump inlet 158. The discharge is connected to a tube 160 which corresponds to duct 44 in FIGS. 1A and 1B, and delivers high pressure power fluid from pump C to control valve E. Pump inlet 158 receives low pressure power fluid from reservoir B through a strainer 162 attached to plate 154 and an opening 164 in the plate. Accumulator 54 (see FIGS. 1A and 1B) communicates with pipe 160 through passage 168 in a mounting plate 170 that also supports strainer 162. The accumulator may be of a conventional gas-loaded diaphragm type.

Figure 5A:
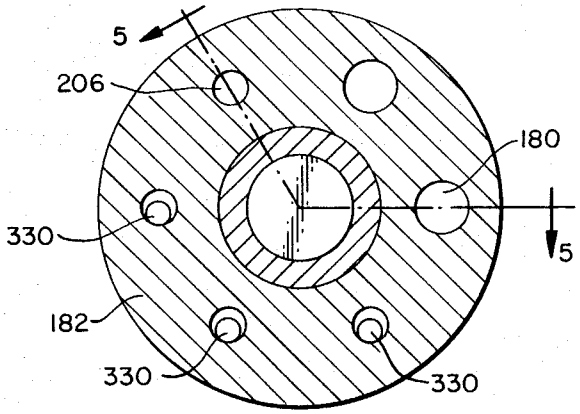
Figure 5:
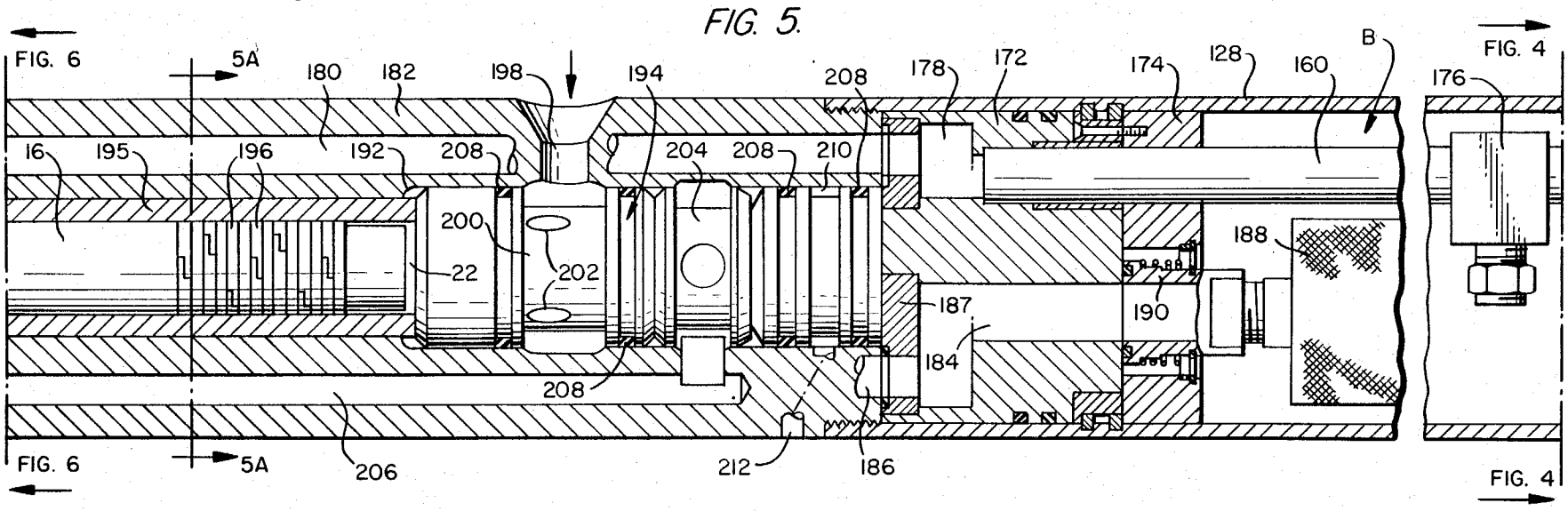

Proceeding to FIG. 5, reservoir B terminates at its left (upper) end in a bulkhead assembly including a bulkhead member 172 and plate 174 located in the end of housing member 128. Tube 160, which includes a high pressure relief valve 176 terminates in bulkhead member 127. A passage 178 in the bulkhead member connects tube 160 to a passage 180 in the succeeding housing member 182, for the onward transmission of high-pressure power fluid from pump C to valve E and piston 10. Housing members 128 and 182 may have a screw connection as shown, or alternatively a flanged connection may be used.

Bulkhead member 172 further includes a passage 184 for the return of low pressure power fluid from valve E to reservoir B via a passage 186 in housing member 182 which corresponds in part to duct 50 in FIGS. 1A and 1B. Passages 180 and 186 respectively connect with passages 178 and 184 in the bulkhead member through openings in a seal plate 187. Passage 184 communicates with the interior of reservoir B via a filter 188 for the return of power fluid. The filter may be provided with a magnet (not shown) for attracting any solid metallic pollutants which may be present in the returning power fluid. Plate 174 may carry a sprung filter by-pass cylinder 190 through which returning fluid normally flows into the filter from passage 184. The bypass cylinder, however, may be moved away from its seat, against the spring action, to allow return fluid to bypass the filter in the event of a rise in return fluid pressure should the filter become clogged.

Referring now jointly to FIGS. 5 and 6, housing member 182 has a longitudinal through-bore 192 with an enlarged section at its right-hand (lower) end in which it accommodates a lower well fluid inlet and discharge check valve assembly 194. Adjacent assembly 194, bore 192 accommodates a liner 195, which defines the lower plunger chamber 22 (FIGS. 1A and 1B) and lower plunger 16. At its right (lower) end, plunger 16 may be provided with a series of rings 196 (10 rings may be provided, for example) to form a seal between the plunger and liner 195, if a steel plunger is used. For a ceramic plunger, however, the rings may be omitted. Chamber 22 communicates with the interior of assembly 194.

Internally, assembly 194 contains the lower inlet check valve 30 and lower discharge check valve 42 (FIGS. 1A and 1B). The internal construction of assembly 194 is not visible in FIG. 5 but is similar to that of the corresponding upper assembly for the inlet and discharge of well fluid (FIG. 10) where the internal constructional details are shown.

Well fluid is drawn into assembly 194 through a transverse passage 198 in housing member 182, which communicates with an inlet manifold 200 of assembly 194. Manifold 200 has circumferential inlet ports 202 which communicate with plunger chamber 22 via the lower inlet check valve (not shown). Passage 198 corresponds to well fluid inlet 28 in FIGS. 1A and 1B. On left-to-right movement (downstrokes) of plunger 16, well fluid from chamber 22 is discharged through assembly 194 via the lower discharge check valve (not shown), discharge manifold 204, and communicating passages formed in housing member 182 including a lengthwise passage 206 corresponding to the lower section of the discharge riser 40 of FIGS. 1A and 1B.

O-rings 208 seal the assembly 194 in bore 192. Between the two right-hand (lowermost) rings, a vent groove 210 is provided which communicates with the exterior of the assembly through a vent passage 212 in member 182. The purpose of the vent groove and passages is to prevent high pressure pumped well fluid from leaking at the joints of seal plate 186 into the clean power fluid passages.

Referring specifically to FIG. 6 the left (upper) end of housing member 182 may have a screw-threaded or other connection to succeeding housing member 62 already referred to in connection with FIG. 7. Adjacent the left (upper) end of liner 195 is a liner spacer 216 with a tapered bore facilitating insertion of plunger 16. A passage 218 in spacer 216 communicates with further vent ports 220 and 222 in housing member 182. The vent ports provide further protection against high pressure well fluid, which may for example leak into the spacer passage past the plunger rings 196.

Adjacent spacer 216 is situated a seal plate 224 carrying a pair of lip seals 226 which engage the plunger and correspond to seal 124 at the lower end of barrier chamber 122 in FIGS. 1A and 1B. A flanged ring 228 abuts seal plate 224 and is secured, as by welding, to the right (lower) end of a cylinder 230. The left (upper) end of cylinder 230 is similarly secured to a further ring 232. Cylinder 230 has an annular clearance around plunger 16, which in use is filled with clean fluid, and defines the lower barrier chamber 122 described in relation to FIGS. 1A and 1B. Ring 232 carries seal plates 234, 236 with lip seals 238 which engage the plunger and correspond to seal 124 at the upper end of barrier chamber 122 in FIGS. 1A and 1B. The purpose and function of the barrier chamber and seals have already been described.

Passage 180 in housing member 182 connects with a tube 240 extending through housing member 62 for the onward transmission of high pressure power fluid from pump C to control valve E. Similarly, passage 206 connects with a tube 242 for the onward transmission of pumped well fluid from plunger chamber 22. Annular space 244 in housing member 62 surrounding cylinder 230 is, in operation, filled with low pressure power fluid returning from valve E to the reservoir. Space 244 communicates with power fluid return passage 186 in housing member 182 (FIG. 5) via an opening 246 in ring 228 (see FIG. 6B).

Ring 232 is secured at its left (upper) end to a retaining plate 248 to which is connected, as by welding, the right (lower) end of a cylinder 250. The left (upper) end of cylinder 250 is similarly connected to a further retaining plate 252 (FIG. 7) attached to valve housing 58. Plunger 16 is connected, for example, by a screw 254 to valve rod section 18.

Cylinder 250 defines internally thereof the annular chamber 113 already referred to in the description of control valve E. In use, chamber 113 receives low pressure power fluid from valve E for return to the reservoir. Ports 256 in cylinder 250 connect annular chamber 113 to an outer annular chamber 258, which in turn communicates with chamber 244 via grooves 260, 262 in plate 248 and ring 232 (see FIG. 6A).

Figure 7A:
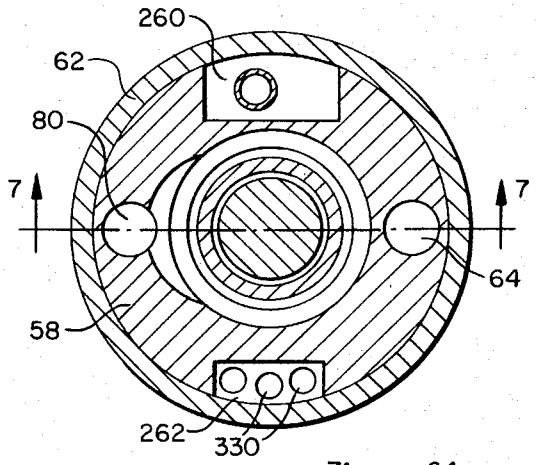
Figure 7:
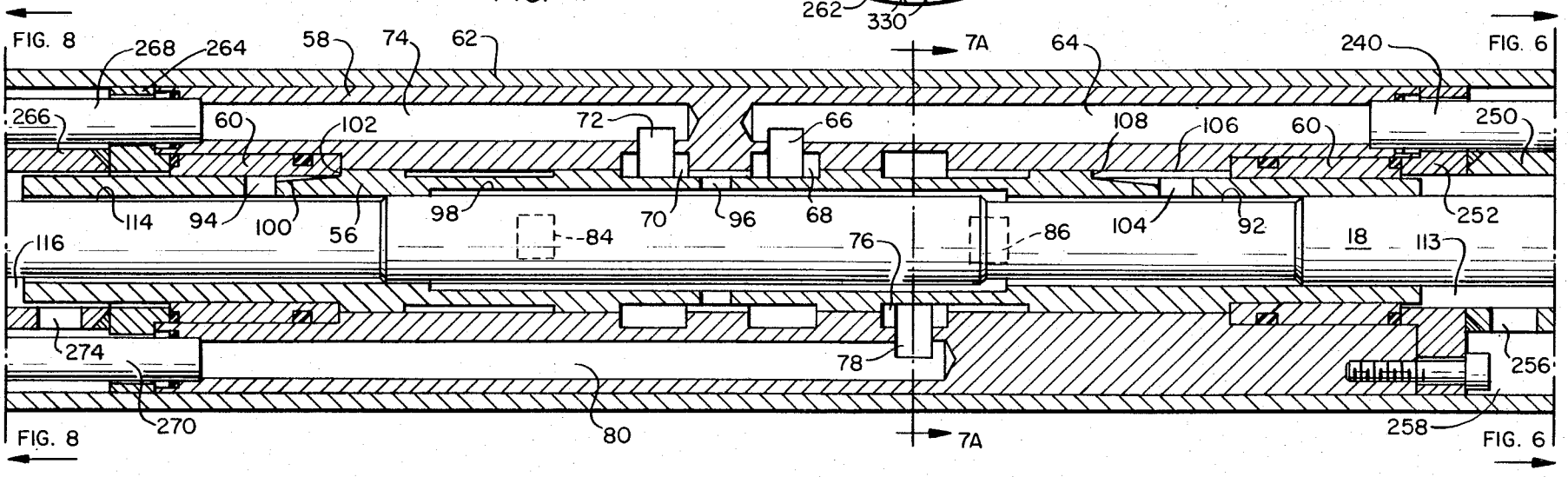

Proceeding to FIG. 7, the control valve structure has already been described and will not be repeated, save for parts of the valve which are not readily apparent in FIG. 7. Thus, ports 84, 86 and passage 82 in the valve housing 58 (see FIGS. 2A–2D) for the return of low pressure power fluid from the valve to the reservoir are not shown in FIG. 7. The positions of ports 84 and 86, however, have been indicated in dotted form, and these communicate with one of the pair of lengthwise channels 260, 262 formed in the valve housing (see FIG. 7A). The channels communicate at their right (lower) ends with annular space 258 via suitable openings in plate 252.

Figure 8A:
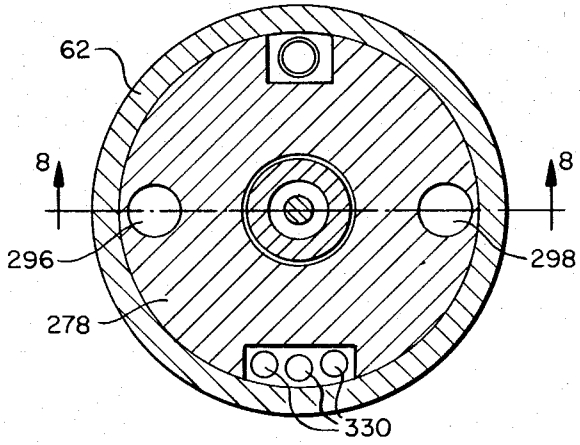
Figure 8:
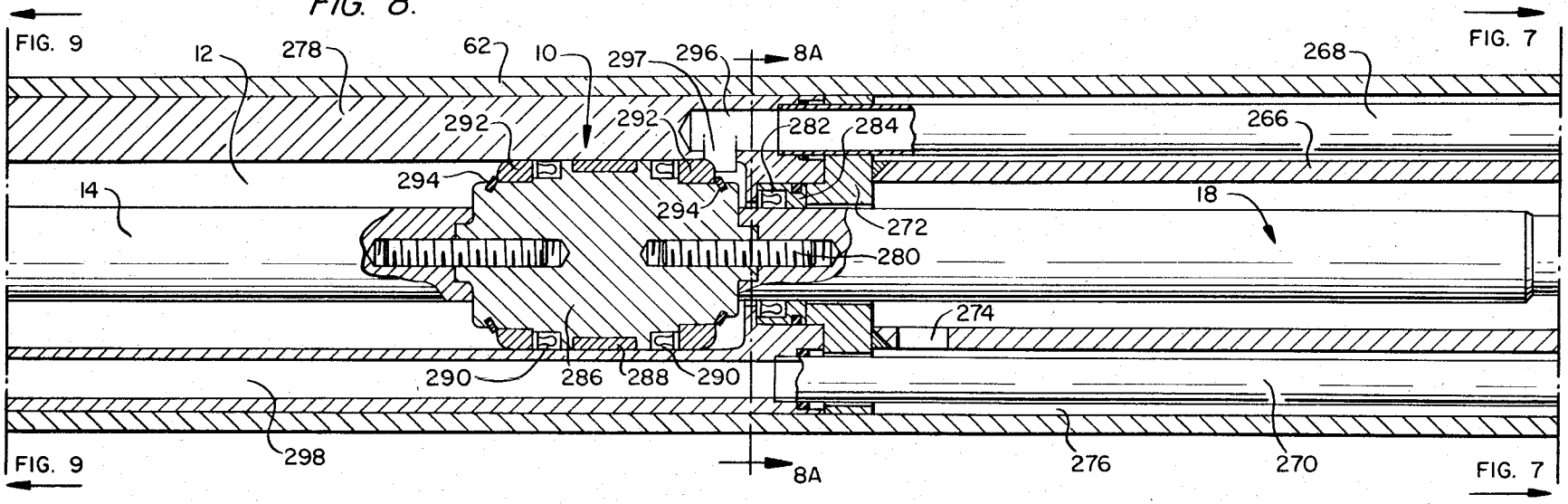

At its left (upper) end valve housing 58 is attached to a plate 264, to which is connected as by welding, a cylinder 266. Passages 74 and 80 in the valve housing provide communication between the control valve and opposite ends of the cylinder 12, respectively, as previously described, and connect, respectively, to tubes 268 and 270. As shown in FIG. 8, the left (upper) end of cylinder 266 is attached to a retainer plate 272.

Internally, cylinder 266 defines the upper annular chamber 116, previously referred to, which receives low pressure power fluid from the control valve for return to the reservoir. Ports 274 in cylinder 266 connect chamber 116 to an outer annular space 276 which communicates with the low pressure power fluid grooves 260, 262 (FIG. 7A) in the valve housing via suitable openings (not shown) in plate 264.

Plate 272 connects to the right (lower) end of a cylinder housing 278, which defines the main power cylinder 12. Valve rod section 18 is connected, e.g., via screw 280, to power piston 10, the opposite (upper) end of which is similarly connected to upper plunger 14. The right (lower) end of cylinder 12 is sealed by a lip seal 282 engaging valve rod section 18, and carried by a seal plate 284 trapped between plate 272 and a flange in cylinder housing 278.

Power piston 10 may comprise a main steel body part 286 externally grooved to receive a central wear ring 288, lip seals 290, seal retaining rings 292, and snap rings 294. Tube 268 communicates with the lower end of cylinder 12 via a passage 296 formed in the cylinder housing, and tube 270 communicates with the upper end of the cylinder (see FIG. 9) via a corresponding passage 298.

As shown in FIG. 8, piston 10 may partially cover outlet ports 297, so as to provide a hydraulic cushion preventing overstroking. A similar action may occur at the opposite end of the stroke. The piston stroke may, for example, be about 8 inches; and to ensure against gas lock, the compression ratio may be about 15 to 1.

The left (upper) end of cylinder housing 278 is connected to a ring 300 (FIG. 9) which carries a seal retaining plate 302 with lip seals 304 which engage plunger 14 to seal the upper end of cylinder 12 and also form seal 124 (FIGS. 1A and 1B) of upper barrier chamber 120. A cylindrical member 306 is connected, as by welding, to ring 300 at its right (lower) end and to a flanged ring 308 at its left (upper) end. Barrier chamber 120 is formed by the annular space between plunger 14 and member 306 and is, in use, filled with barrier fluid as previously described.

Adjacent ring 308 is a further seal retaining plate 310 with lip seals 312 which correspond to the upper seal 124 (FIGS. 1A and 1B) for the barrier chamber 120. Ring 308 mates with an upper cylinder member 314 having a liner 316 which defines upper plunger chamber 20. Plunger 14 has seals 318 like seals 196 of the lower plunger (FIG. 5). Between liner 316 and seal retaining plate 310 is a liner spacer 320 corresponding to spacer 216 (FIG. 6) of the lower plunger chamber. Spacer 320 has a passage 322 which communicates with a passage 324 in cylinder member 314 and thus with upper well fluid inlet 24 (FIGS. 1A and 1B and FIG. 10) to provide a vent for well fluid equivalent to vent 220 in the lower plunger chamber.

Figure 9:
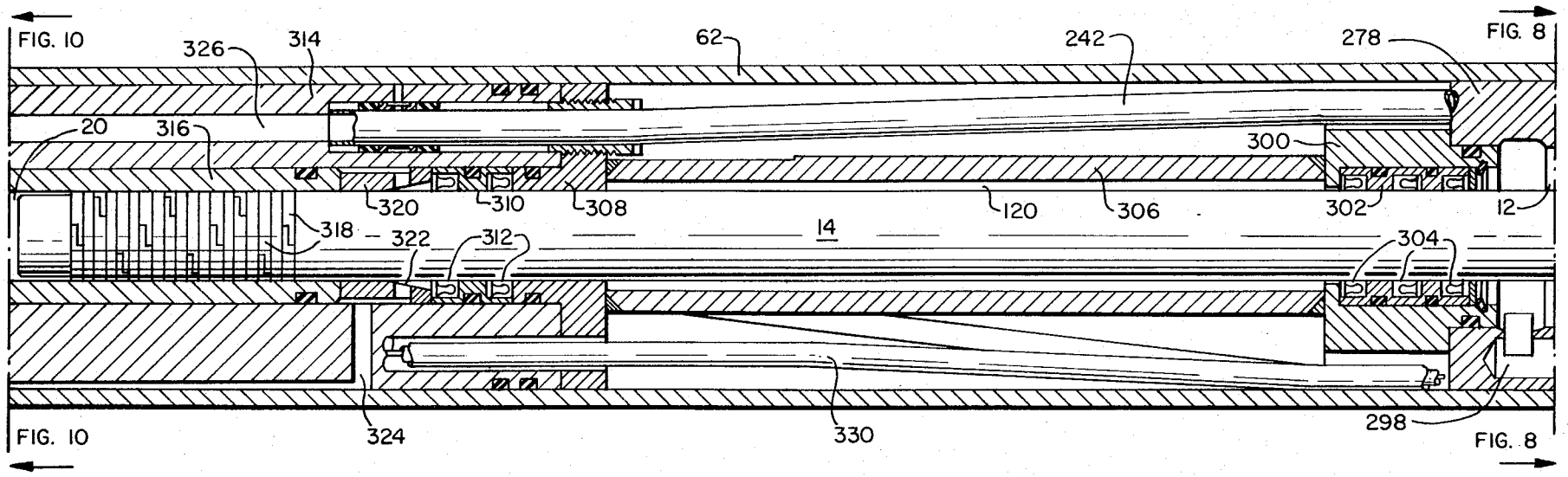
Figure 10:
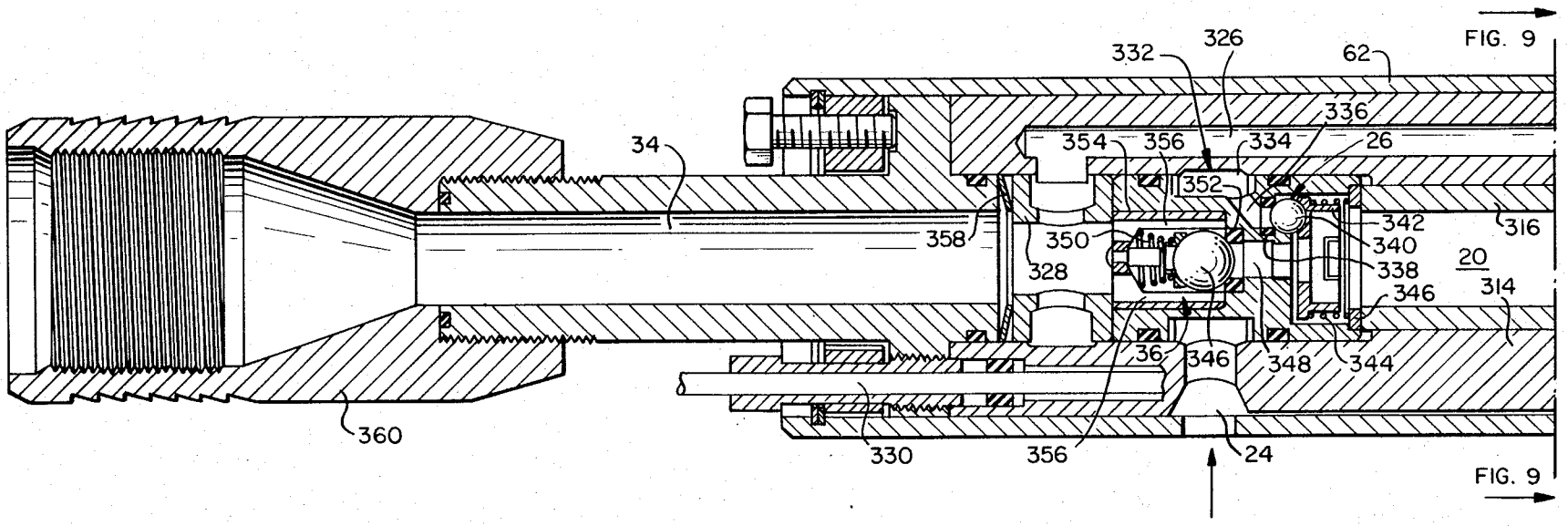

FIG. 9 also shows the continuation of tube 242 (see FIG. 6) which carries pumped well fluid from the lower plunger chamber to the discharge fitting 34 of the assembly (FIGS. 1A and 1B and FIG. 10). Tube 242 connects with a passage 326 in housing 314, and passage 326 leads into a manifold 328 (FIG. 10) at the base of the discharge fitting. Further evident in FIG. 9 is sheathed electrical wiring 330 (see also FIG. 10) which may extend through the assembly for activating the motor D, where, for example, the assembly is to be used in a relatively narrow well casing. Suitable openings and seals may be provided for the wiring down the length of the pumping assembly in the various plates, bulkheads and the like. General reference 330 is used to indicate the wiring where it is shown in the various figures. As an alternative, for example, in larger diameter wells the wiring for motor D may be external to the pumping apparatus.

Referring now specifically to FIG. 10, this shows the upper well fluid inlet and discharge check valve assembly 332 in cross section. As noted previously, assembly 332 is similar to the equivalent lower assembly 194 (FIG. 5). Assembly 332 contains both the upper inlet check valve 26 and the upper discharge check valve 36 (see also FIGS. 1A and 1B). Considering firstly the inlet valve arrangement, well fluid inlet 24 communicates with a manifold 334 having circumferential ports (not shown but equivalent to ports 202 in the lower assembly). The ports, in turn, communicate with circumferentially spaced passages 336 each terminating in a valve seat 338. A steel ball 340 sits on each valve seat and constitutes a movable valve element urged toward the seat by a sprung cage 342. A coil spring 344 for the cage acts against a washer 346 trapped against the end of liner 316. There are preferably three passages 336 and balls 340, equally spaced circumferentially so as to equalize the pressure forces. It will be evident that when plunger 14 is moving to the right (downwardly), creating suction in chamber 20, balls 340 can move off their seats against the spring action, so as to admit well fluid to the chamber; but when the plunger is moving to the left (upwardly) to pump fluid from the chamber, balls 340 are pushed against their seats so as to block the fluid inlet to chamber 20.

The discharge check valve 36 includes a single ball 346 controlling a central axial passage 348 leading from chamber 20. Ball 346 is held in a spider fitting 354 which includes a spring assembly 350 urging the ball against a seat 352 at the end of passage 348. Fitting 354 includes circumferentially spaced lengthwise passages 356 which communicate with passage 348 when ball 346 is moved away from its seat against the spring pressure. This occurs on pumping strokes of plunger 14, whereby well fluid is discharged from chamber 20 into manifold 328 via passages 348 and 356, and then into discharge fitting 34.

Manifold 328 and assembly 332 are held against the end of liner 316 by a Bellville washer 358 trapped between the manifold and the discharge fitting. The end of the discharge fitting may be connected to a head fitting 360, which may itself be connected to discharge tubing.

It will be appreciated that the pumping apparatus shown in detail in FIGS. 4–10 operates in exactly the manner described with reference to FIGS. 1A, 1B and FIGS. 2A to 2D. As previously indicated, the pumping apparatus is considered particularly effective for use in deep wells of low output.

While only preferred embodiments of the invention have been described herein in detail, the invention is not limited thereby and modifications can be made within the scope of the attached claims.

What is claimed is:

1. Submergible pumping apparatus for use in oil and other wells comprising, in a downhole unit, a piston-plunger assembly including a power piston adapted to reciprocate in a power cylinder, and a plunger connected to the piston for reciprocation in a plunger chamber, inlet valve means for admitting well fluid to the plunger chamber on suction strokes of the plunger within the chamber, discharge valve means for discharging well fluid from the plunger chamber into a discharge means on pumping strokes of the plunger within the chamber, a power fluid reservoir, pump means for delivering high pressure power fluid from the reservoir to the power cylinder for operating the power piston, and a control valve for effecting stroke reversal of the power piston by alternately providing connections for the high pressure power fluid to one or the other end of the power cylinder and for low pressure power fluid from said other or said one end of the power cylinder to the reservoir, and reversing said connections when the power piston approaches opposite ends of its stroke, respectively, the control valve comprising a spool valve including a reciprocating valve rod section formed as a part of said piston-plunger assembly, and including a reciprocating valve spool encircling the valve rod section and disposed in a stationary valve housing, the valve housing including passage means providing communication for power fluid between the reservoir, the control valve, and the power cylinder, and port means providing communication between the passage means and the exterior of the valve spool, the control valve further including a central vent hole in the valve spool connecting the exterior of the spool with an internal spool groove, further vent holes at opposite ends of the spool respectively connecting the interior of the spool with respective actuating annuli defined between opposite end portions of the spool exterior and the valve housing, and spaced annular grooves in the valve rod section for connecting the central vent hole to one of the actuating annuli while venting the other of the annuli to the reservoir when the piston-plunger assembly approaches one end of its stroke, so as to apply fluid pressure to the valve spool in a manner axially shifting the valve spool in one direction, thereby reversing said connections, the central vent hole likewise being connected to the other actuating annulus while said one actuating annulus is vented, when the piston-plunger assembly approaches the other end of its stroke, so as to apply fluid pressure to the valve spool axially shifting the spool in reverse direction.

2. Apparatus as defined in claim 1, wherein the exterior of the valve spool has chamfered portions leading from the respective further vent holes so as to provide a cushioning effect for the valve spool at opposite ends of its stroke.

* * * * *